US005682762A

United States Patent [19]

Agrawal et al.

[11] Patent Number: 5,682,762

[45] Date of Patent: Nov. 4, 1997

[54] PROCESS TO PRODUCE HIGH PRESSURE NITROGEN USING A HIGH PRESSURE COLUMN AND ONE OR MORE LOWER PRESSURE COLUMNS

[75] Inventors: Rakesh Agrawal, Emmaus; Zbigniew Tadeusz Fidkowski, Macungie, both of Pa.

[73] Assignee: Air Products and Chemicals, Inc., Allentown, Pa.

[21] Appl. No.: 724,332

[22] Filed: Oct. 1, 1996

[51] Int. Cl.[6] ..... F25J 3/04

[52] U.S. Cl. ..... 62/643; 62/648; 62/653

[58] Field of Search ..... 62/643, 644, 648, 62/653

[56] References Cited

U.S. PATENT DOCUMENTS

| | | | |
|---|---|---|---|
| 4,192,662 | 3/1980 | Ogata et al. | 62/643 |
| 4,222,756 | 9/1980 | Thorogood . | |
| 4,439,220 | 3/1984 | Olszewski et al. . | |
| 4,448,595 | 5/1984 | Cheung . | |
| 4,453,957 | 6/1984 | Pahade et al. . | |
| 4,594,085 | 6/1986 | Cheung . | |
| 4,604,117 | 8/1986 | Cheung . | |
| 4,615,716 | 10/1986 | Cormier et al. | 62/643 |
| 4,617,036 | 10/1986 | Suchedo et al. . | |
| 4,662,916 | 5/1987 | Agrawal et al. . | |
| 4,717,410 | 1/1988 | Grenier . | |
| 4,927,441 | 5/1990 | Agrawal . | |
| 4,962,646 | 10/1990 | Rathbone | 62/653 X |
| 4,966,002 | 10/1990 | Parker et al. . | |
| 5,006,139 | 4/1991 | Agrawal et al. . | |
| 5,037,462 | 8/1991 | Schweigert . | |
| 5,069,699 | 12/1991 | Agrawal . | |
| 5,098,457 | 3/1992 | Cheung et al. . | |
| 5,129,932 | 7/1992 | Agrawal et al. . | |
| 5,228,297 | 7/1993 | Olsen, Jr. et al. | 62/647 |
| 5,251,449 | 10/1993 | Rottmann | 62/653 X |
| 5,309,721 | 5/1994 | Rathbone | 62/647 |
| 5,325,674 | 7/1994 | Gastinne et al. . | |
| 5,373,699 | 12/1994 | Gastinne et al. . | |
| 5,385,024 | 1/1995 | Roberts et al. . | |
| 5,402,647 | 4/1995 | Bonaquist et al. . | |

FOREIGN PATENT DOCUMENTS

| | | |
|---|---|---|
| 0701099A1 | 3/1996 | European Pat. Off. . |
| 1215377 | 12/1970 | United Kingdom . |

*Primary Examiner*—Christopher Kilner
*Attorney, Agent, or Firm*—Robert J. Wolff

[57] ABSTRACT

A process is set forth for the cryogenic distillation of an air feed to produce high pressure nitrogen of various purity, varying from moderately high purity (99.9% nitrogen) to ultra-high purity (less than 1 part per billion of oxygen). The process is particularly suited for cases where the high pressure nitrogen is needed directly from the distillation column system to avoid contamination concerns associated with compressing nitrogen that is produced at lower pressures. The process uses a high pressure column, which operates at a pressure to directly produce the nitrogen at the desired high pressure, and one or more lower pressure columns which produces a portion of the nitrogen product at a lower pressure. At least a portion of the lower pressure nitrogen is compressed and fed to the high pressure column at a location which is below the removal location of the high pressure nitrogen.

5 Claims, 4 Drawing Sheets

PROCESS TO PRODUCE HIGH PRESSURE NITROGEN USING A HIGH PRESSURE COLUMN AND ONE OR MORE LOWER PRESSURE COLUMNS

TECHNICAL FIELD OF THE INVENTION

The present invention relates to a process for the cryogenic distillation of an air feed. As used herein, the term "air feed" generally means atmospheric air but also includes any gas mixture containing at least oxygen and nitrogen.

BACKGROUND OF THE INVENTION

The target market of the present invention is high pressure (pressure greater than 60 psia) nitrogen of various high purity, varying from moderately high purity (99.9% nitrogen) to ultra-high purity (less than 1 part per billion of oxygen) such as the nitrogen which is used in various branches of the chemical and electronic industry. Some applications may require delivery of the high pressure and high purity nitrogen directly from the distillation column system to avoid contamination concerns associated with compressing nitrogen that is produced at lower pressures. It is an objective of the present invention to design an efficient cryogenic cycle to meet these needs.

There are several processes known in the art of the production of nitrogen. The processes can be classified according to the number of distillation columns as single column cycles, single column with pre-fractionators or post-fractionators, double column cycles and cycles containing more than two distillation columns.

A classic single column nitrogen cycle is taught in U.S. Pat. No. 4,222,756. Vapor air is fed to the bottom of a rectifier, where it is separated into overhead vapor nitrogen and a bottom liquid, which is let down in pressure and boiled at the top of the column providing necessary reflux by indirect heat exchange with overhead vapor. The oxygen-enriched vapor from the top reboiler/condenser is discarded as a waste stream.

An advantage of a single column nitrogen generator is its simplicity. A big disadvantage of this cycle is limited recovery of nitrogen. Various other types of single column nitrogen generators were proposed to increase nitrogen recovery. In U.S. Pat. No. 4,594,085, an auxiliary reboiler was employed at the bottom of the column to vaporize a portion of the bottom liquid against air, forming additional liquid air feed to the column. In U.S. Pat. Nos. 5,325,674 and 5,373,699 compressed nitrogen, rather than air, is used as a heating medium in the auxiliary reboiler. This nitrogen, after condensing in the auxiliary reboiler, is fed as additional reflux to the top of the column, thereby increasing product recovery. A similar cycle enriched only with an air compander is taught in U.S. Pat. No. 5,037,462. A single column cycle with two reboilers is taught in U.S. Pat. No. 4,662,916. Yet another single column cycle, where a portion of the oxygen-enriched waste stream is compressed and recycled back to the column to further increase nitrogen recovery, is described in U.S. Pat. No. 4,966,002. Similarly, in U.S. Pat. No. 5,385,024 a portion of the oxygen-enriched waste stream is cold companded and recycled back to the column with feed air.

Nitrogen recovery in a single column system is considerably improved by addition of a second distillation unit. This unit can be a full distillation column or a small pre/post-fractionator built as a flash device or a small column containing just a few stages. A cycle consisting of a single column with a pre-fractionator, where a portion of a feed air is separated to form new feeds to the main column is taught in U.S. Pat. No. 4,604,117. In U.S. Pat. No. 4,927,441 a nitrogen generation cycle is taught with a post-fractionator mounted on the top of the rectifier, where oxygen-enriched bottom liquid is separated into even more oxygen-enriched fluid and a vapor stream with a composition similar to air. This synthetic air stream is recycled to the rectifier, resulting in highly improved product recovery and cycle efficiency. Also, the use of two reboilers to vaporize oxygen-enriched fluid twice at different pressures improves the cycle efficiency even further.

Classic double column cycles for nitrogen production are taught in U.S. Pat. No. 4,222,756. The novel distillation configuration taught in this patent consists of the double column with an additional reboiler/condenser at the top of the lower pressure column, to provide reflux to the lower pressure column by vaporizing the oxygen-enriched waste fluid. Refrigeration is created by expanding nitrogen gas from the high pressure column.

A similar distillation configuration (with different fluids expanded for refrigeration) is taught in GB Patent 1,215,377 and U.S. Pat. No. 4,453,957. In U.S. Pat. No. 4,617,036, a side reboiler/condenser is employed instead of the heat exchanger at the top on the low pressure column. A dual column cycle with intermediate reboiler in the low pressure column is taught in U.S. Pat. No. 5,006,139. A cycle for production of moderate pressure nitrogen and coproduction of oxygen and argon was described in U.S. Pat. No. 5,129,932.

A different dual column high pressure nitrogen process is taught in EP 0701099A1. The major difference is that the entire air feed is fed to the low pressure column (instead of the high pressure column) in order to separate nitrogen from the air feed and, subsequently, the entire portion of this nitrogen (which is required at high pressure) is compressed and recycled back to the high pressure column where it is additionally purified from heavier components and eventual impurities that might have been introduced by the recycle compressor.

The dual column high pressure nitrogen process taught in U.S. Pat. No. 4,439,220 can be viewed as two standard single column nitrogen generators in series (this configuration is also known as a split column cycle). U.S. Pat. No. 4,448,595 differs from a split column cycle in that the lower pressure column is additionally equipped with a reboiler. In U.S. Pat. Nos. 4,717,410 and 5,098,457, yet another variation of the split column cycle is shown where the nitrogen liquid product from the top of low pressure column is pumped back to the high pressure column, to increase recovery of the high pressure product.

A triple column cycle for nitrogen production is described in U.S. Pat. No. 5,069,699 where an extra high pressure distillation column is used for added nitrogen production in addition to a double column system with a dual reboiler. Another triple column system for producing large quantities of elevated pressure nitrogen is taught in U.S. Pat. No. 5,402,647. In this invention, the additional column operates at a pressure intermediate to that of higher and lower pressure columns. Furthermore, in this patent and in U.S. Pat. Nos. 4,717,410 and 5,098,457, when all the nitrogen is needed at a high pressure from the high pressure column, a liquid nitrogen stream from the low pressure column is pumped to the high pressure column, and in lieu of this high pressure, nitrogen vapor is collected from the high pressure column. The problem with pumping liquid nitrogen from one column to another column is that overall nitrogen recovery drops substantially. All the prior art nitrogen cycles have the following disadvantage: recovery of high pressure nitrogen from the column system is limited and cannot be increased.

SUMMARY OF THE INVENTION

The present invention is a process for the cryogenic distillation of an air feed to produce high pressure nitrogen of various purity, varying from moderately high purity (99.9% nitrogen) to ultra-high purity (less than 1 part per billion of oxygen). The process is particularly suited for cases where the high pressure nitrogen is needed directly from the distillation column system to avoid contamination concerns associated with compressing nitrogen that is produced at lower pressures. The process uses a high pressure column, which operates at a pressure to directly produce the nitrogen at the desired high pressure, and one or more lower pressure columns which produces a portion of the nitrogen product at a lower pressure. At least a portion of the lower pressure nitrogen is compressed and fed to the high pressure column at a location which is below the removal location of the high pressure nitrogen.

DETAILED DESCRIPTION OF THE INVENTION

Figure 1:
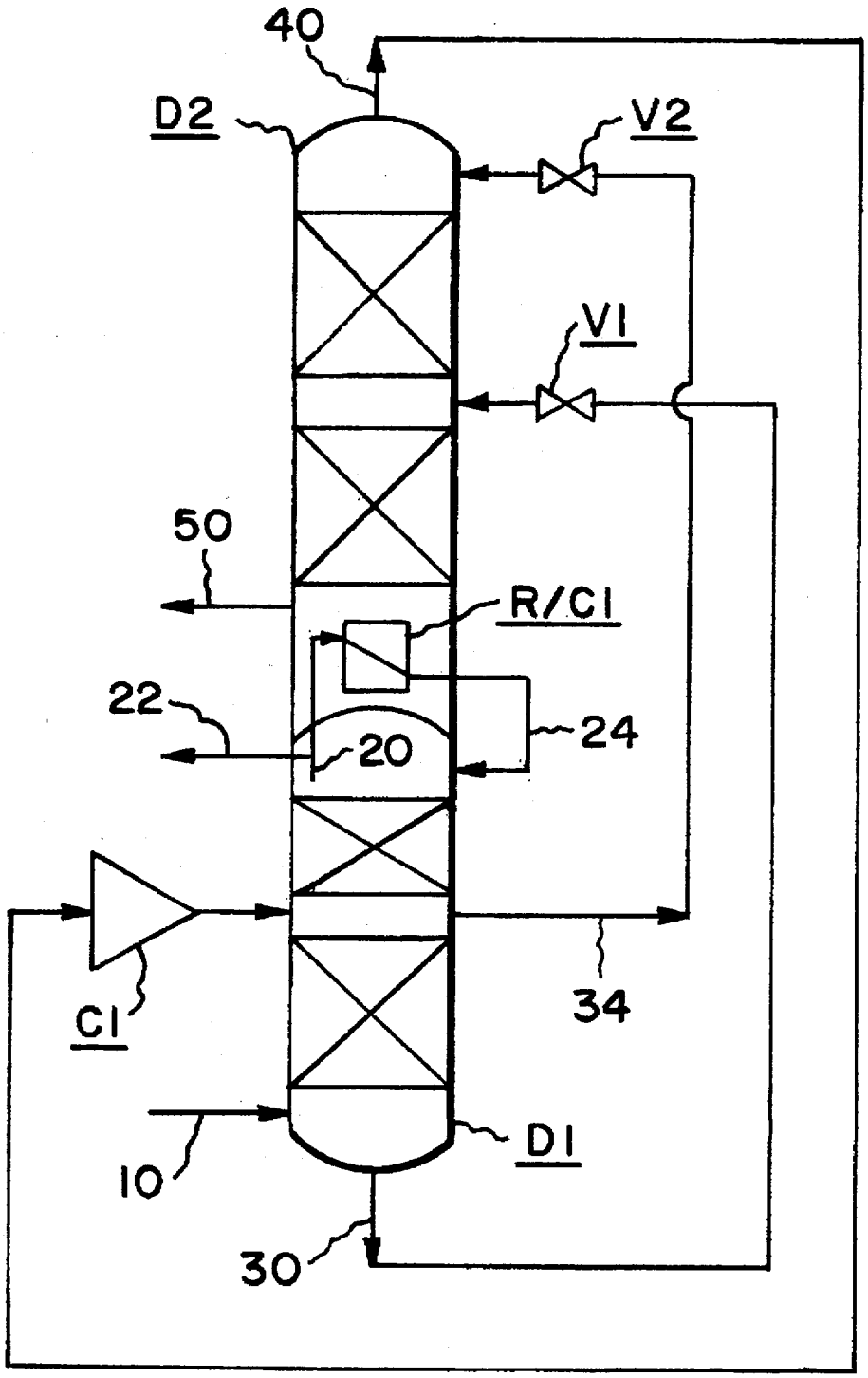
FIG. 1 is a schematic drawing of one general embodiment of the present invention.

The present invention is a process for the cryogenic distillation of an air feed to produce a high pressure nitrogen product using a distillation column system comprising a high pressure column and one or more lower pressure columns. In its broadest embodiment, and with reference to any or all of FIGS. 1–4, the process comprises:

(a) feeding at least a portion of the air feed [1 0] to the bottom of the high pressure column [D1];

(b) removing a nitrogen-enriched overhead [20] from the top of the high pressure column, collecting a first portion [22] as the high pressure nitrogen product, condensing a second portion in a first reboiler/condenser [R/C1] and feeding at least a first part [24] of the condensed second portion as reflux to an upper location in the high pressure column;

(c) removing a crude liquid oxygen stream [30] from the bottom of the high pressure column, reducing the pressure of at least a first portion of it [across valve V1] and feeding said first portion to the distillation column system for further processing;

(d) removing a nitrogen rich overhead from the top of each lower pressure column, compressing and subsequently feeding at least a first portion of one or more of said overheads to the high pressure column at a location which is below the removal location of the high pressure nitrogen product [22] in step (b); and (e) removing an oxygen rich waste stream from the distillation column system.

The pressure of the high pressure column in the present invention is set slightly higher than the pressure specification for the nitrogen product which is removed from this column in order to account for pressure drops. The pressure of at least one of the remaining distillation columns in the system is set lower than the pressure of the high pressure column to ensure a proper heat integration between columns and/or process streams. The lower pressure distillation column(s) also produces nitrogen, but its pressure is usually too low and does not meet required specifications for certain customers, especially in electronic industry. These customers require that all the high pressure and high purity nitrogen is produced directly from the column system and post compression of this low pressure nitrogen is not acceptable because of contamination concerns. Therefore, until now, the lower pressure nitrogen could not have been delivered as an acceptable product. The present invention transform this unused lower pressure nitrogen into a high pressure, high purity product. To do that, the lower pressure nitrogen is compressed and returned back to the high pressure column. The recycle nitrogen stream enters the higher pressure column below the place where the high purity product is withdrawn to clean it up from all the possible contamination in the recycle loop (like micro-particulates or hydrocarbons). It should be noted that because the recycle lower pressure nitrogen is additionally purified in the high pressure column, the lower pressure column may not have to produce nitrogen of very high purity which would reduce the capital cost associated with the height of the lower pressure column.

The present invention is applicable to any multiple distillation column system that produces nitrogen. The following embodiments are for illustrative purposes only.

In one general embodiment of the present invention, and with specific reference to FIG. 1:

(i) the distillation column system comprises a single lower pressure column [D2];

(ii) the first reboiler/condenser [R/C1] is located in the bottom of the single lower pressure column;

(iii) in step (c), the crude liquid oxygen stream [30] is more specifically fed to an intermediate location in the single lower pressure column;

(iv) in step (d), the entire nitrogen rich overhead [40] which is removed from the single lower pressure column is compressed [in compressor C1] and subsequently fed to the high pressure column;

(v) in step (e), the oxygen rich waste stream [50] is more specifically removed from a lower location in the single lower pressure column; and (vi) a portion of the nitrogen-enriched liquid [34] descending the high pressure column is removed from an intermediate location in the high pressure column, reduced in pressure [across valve V2] and fed as reflux to the top of the single lower pressure column.

In FIG. 1, it should be noted that stream 34 is preferably removed from the high pressure column at a location below the removal point of the high pressure nitrogen product [22] since the purity of this reflux stream does not have to be as high as the purity of the high pressure nitrogen product. However, if needed, this reflux stream could be withdrawn from the top of the high pressure column [D1].

Figure 2:
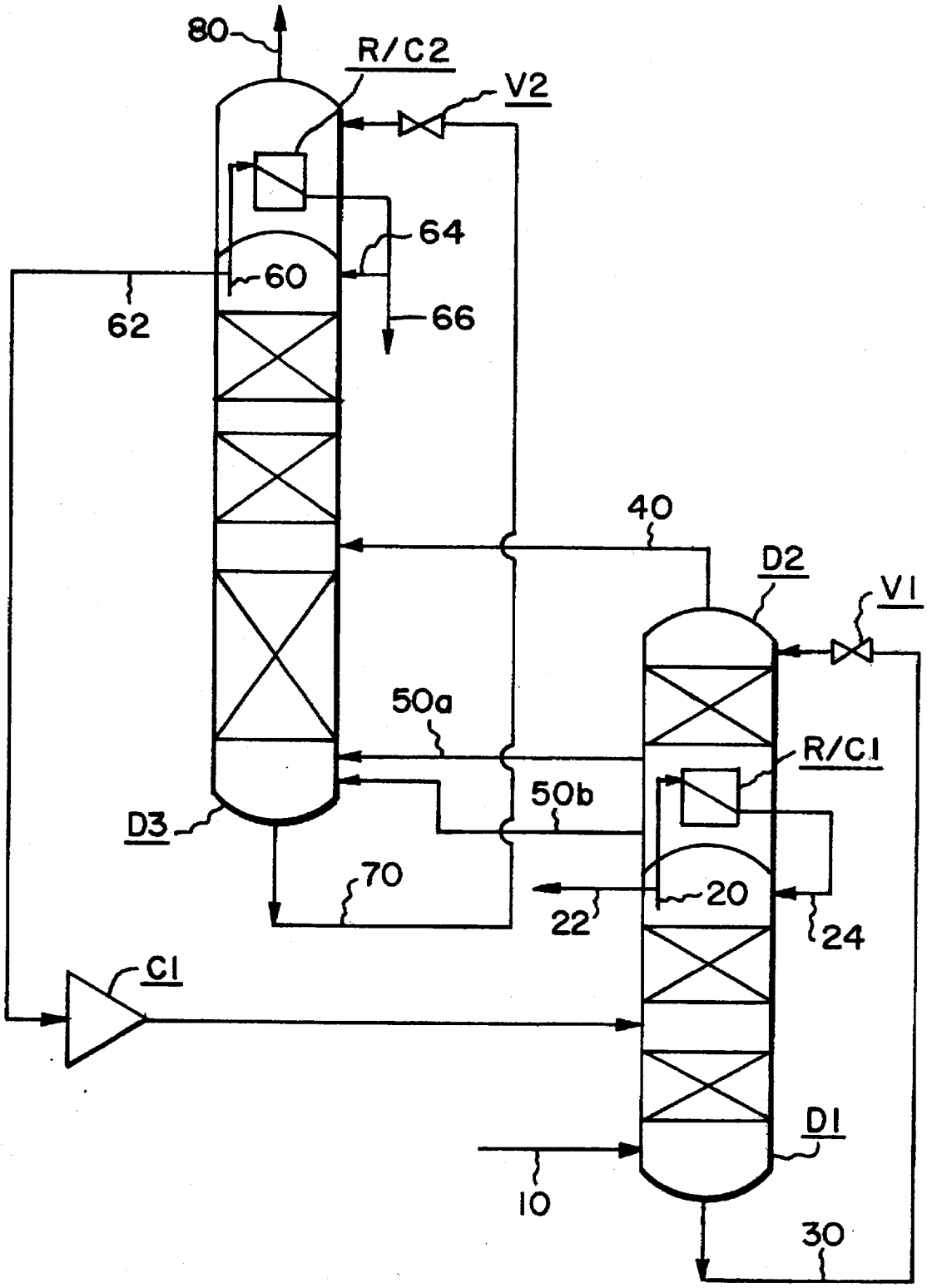
FIG. 2 is a schematic drawing of a second general embodiment of the present invention.

In a second general embodiment of the present invention, and with specific reference to FIG. 2:

(i) the distillation column system comprises two lower pressure columns, namely a first lower pressure column [D2] and a second lower pressure column [D3];

(ii) the first reboiler/condenser [R/C1] is located in the bottom of the first lower pressure column;

(iii) in step (c), the crude liquid oxygen stream [30] is more specifically fed to the top of the first lower pressure column;

(iv) in step (d), the entire nitrogen rich overhead [40] which is removed from the first lower pressure column is fed to an intermediate location in the second lower pressure column while only a first portion [62] of the nitrogen rich overhead [60] from the second lower pressure column is compressed [in compressor C1] and subsequently fed to the high pressure column;

(v) a second portion of the nitrogen rich overhead from the second lower pressure column is condensed in a second reboiler/condenser [R/C2] located at the top of the second lower pressure column, a first part [64] of the condensed second portion is fed as reflux to the top of the second lower pressure column and a second part [66] of the condensed second portion is collected as an optional product stream;

(vi) a first oxygen-enriched vapor stream [50*a*] is removed from a location in the first lower pressure column immediately above the first reboiler/condenser [R/C1], a second oxygen-enriched liquid stream [50*b*] is removed from the bottom of the first lower pressure column and both the first and second oxygen-enriched streams are fed to the bottom of the second lower pressure column; and (vii) an oxygen rich liquid stream [70] is removed from the bottom of the second lower pressure column, reduced in pressure [across valve V2], vaporized in the second reboiler/condenser [R/C2] and removed as the oxygen rich waste stream [80].

Figure 3:
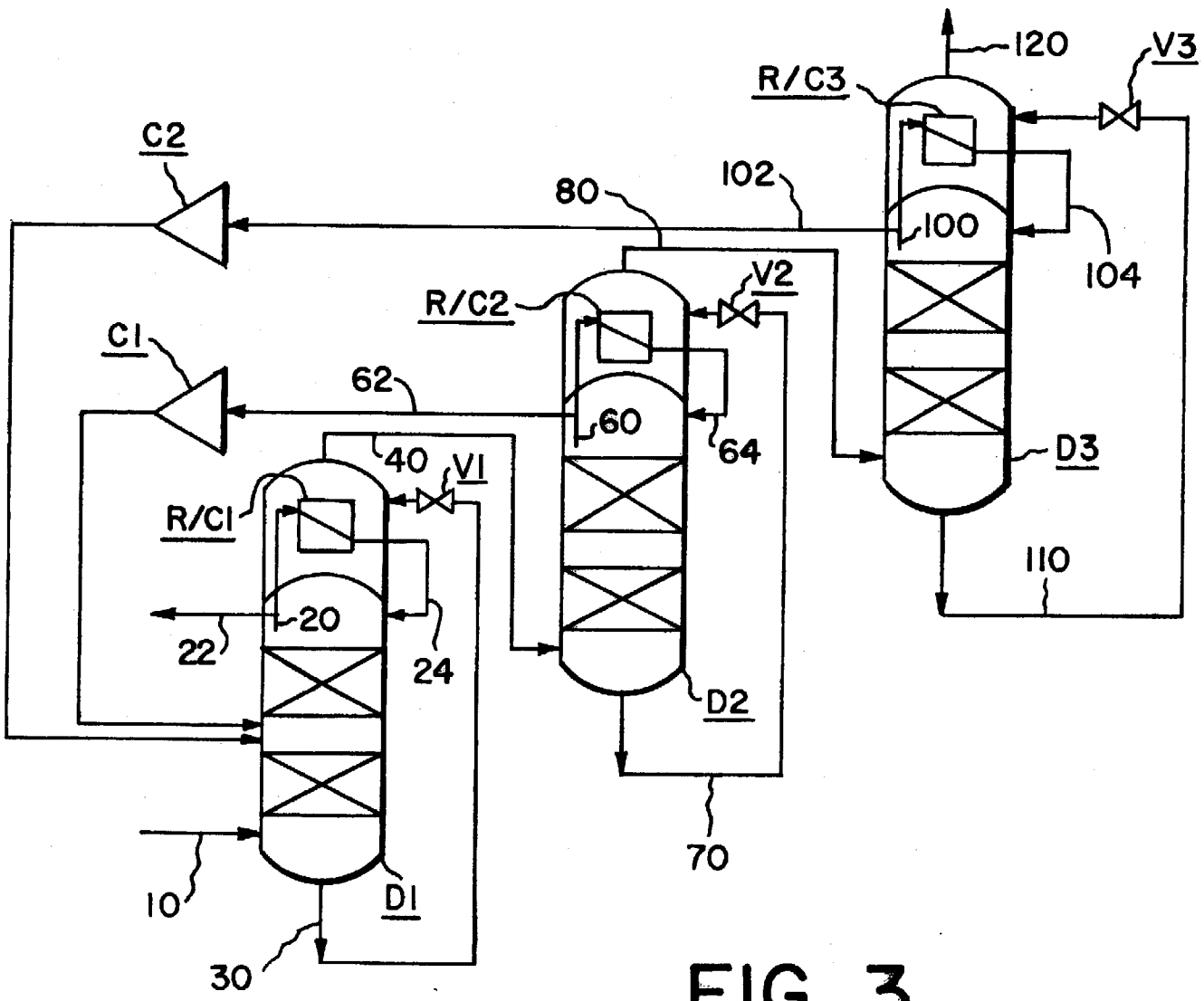
FIG. 3 is a schematic drawing of a third general embodiment of the present invention.

In a third general embodiment of the present invention, and with specific reference to FIG. 3:

(i) the distillation column system comprises two lower pressure columns, namely a first lower pressure column [D2] and a second lower pressure column [D3];

(ii) the first reboiler/condenser [R/C1] is located on top of the high pressure column;

(iii) in step (c), the crude liquid oxygen stream [30] is more specifically fed to the first reboiler/condenser where it is vaporized and subsequently fed [as stream 40] to the bottom of the first lower pressure column;

(iv) in step (d), only a first portion [62] of the nitrogen rich overhead [60] from the first lower pressure column is compressed [in compressor C1] and subsequently fed to the high pressure column and, similarly, only a first portion [102] of the nitrogen rich overhead [100] from the second lower pressure column is compressed [in compressor C2] and subsequently fed to the high pressure column;

(v) a second portion [64] of the nitrogen rich overhead from the first lower pressure column is condensed in a second reboiler/condenser [R/C2] located at the top of the first lower pressure column and subsequently fed as reflux to the top of the first lower pressure column;

(vi) an oxygen rich liquid stream [70] is removed from the bottom of the first lower pressure column, reduced in pressure [across valve V2], vaporized in the second reboiler/condenser [R/C2] and subsequently fed [as stream 80] to the bottom of the second lower pressure column;

(vii) a second portion [104] of the nitrogen rich overhead from the second lower pressure column is condensed in a third reboiler/condenser [R/C3] located at the top of the second lower pressure column and subsequently fed as reflux to the top of the second lower pressure column; and (viii) an oxygen rich liquid stream [110] is removed from the bottom of the second lower pressure column, reduced in pressure [across valve V3], vaporized in the third reboiler/condenser [R/C3] and removed as the oxygen rich waste stream [120].

Figure 4:
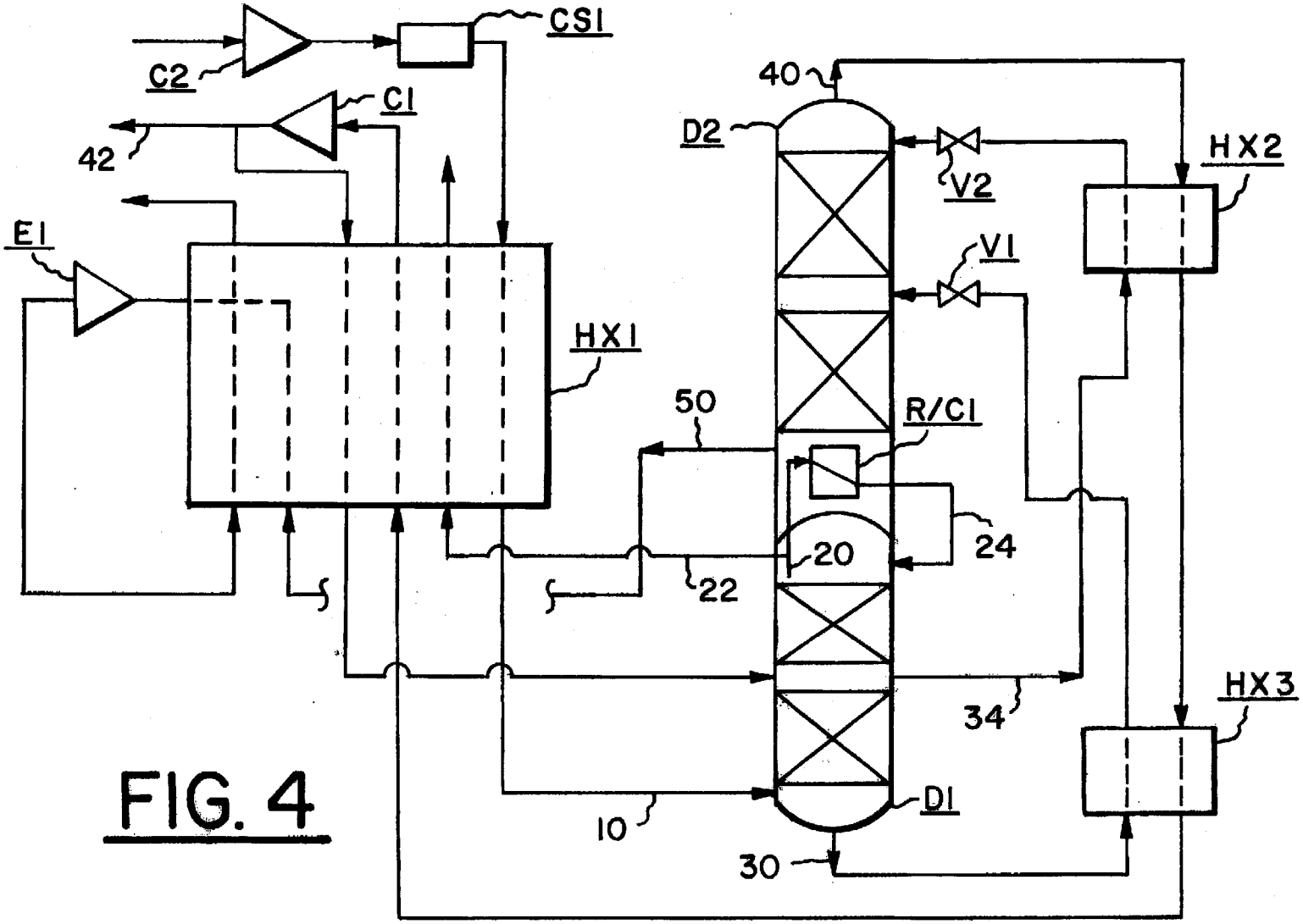
FIG. 4 is a schematic drawing of one embodiment of FIG. 1 which illustrates one example of how the various embodiments of the present invention can be integrated with a main heat exchanger, subcooling heat exchangers and a refrigeration generating expander.

It should be noted that, for simplicity, the main heat exchanger and the refrigeration generating expander scheme have been omitted from FIGS. 1–3. The main heat exchanger and the various expander schemes can easily be incorporated by one skilled in the art. The candidates of likely streams to be expanded include:

(i) at least a portion of the air feed, which after expansion, would generally be fed to an appropriate location in the distillation column system; and/or (ii) at least a portion of one or more of the waste streams that are produced in the various embodiments, which after expansion, would generally be warmed in the main heat exchanger against the incoming air feed (as an example, this scheme is shown in FIG. 4 discussed below); and/or (iii) a portion of the compressed low pressure nitrogen from the top of one or more of the lower pressure columns, which after expansion, would generally be warmed in the main heat exchanger against the incoming air feed.

It should further be noted that, for simplicity, other ordinary features of an air separation process have been omitted from FIGS. 1–3, including the main air compressor, the front end clean-up system, and the subcooling heat exchangers. These features can also easily be incorporated by one skilled in the art. FIG. 4, as applied to FIG. 1 (common streams and equipment use the same identification as in FIG. 1) is one example of how these ordinary features (including the main heat exchanger and an expander scheme) can be incorporated.

With reference to FIG. 4:

(i) prior to feeding the air feed [1 0] to the bottom of the high pressure column in step (a), the air feed is compressed [in compressor C2], cleaned [in a clean-up system CS1] of impurities which will freeze out at cryogenic temperatures (ie water and carbon dioxide) and/or other undesirable impurities (such as carbon monoxide and hydrogen) and cooled in a main heat exchanger [HX1] to a temperature near its dew point;

(ii) prior to compressing the nitrogen rich overhead [40] [in compressor C1] in step (d), said overhead is warmed in the main heat exchanger;

(iii) subsequent to compressing the nitrogen rich overhead [40] in step (d), a portion [42] of said overhead is optionally removed as a product stream and the remaining portion is subsequently cooled in the main heat exchanger and fed to the high pressure column;

(iv) subsequent to removing the high pressure nitrogen product [22] from the high pressure column in step (b), said product is warmed in the main heat exchanger;

(v) subsequent to removing the oxygen rich waste stream [50] from the single lower pressure column in step (e), said waste stream is partially warmed in the main heat exchanger, expanded [in expander E1] and re-warmed in the main heat exchanger; and (vi) prior to warming the nitrogen rich overhead [40] in the main heat exchanger, said overhead is first warmed in a first subcooling heat exchanger [HX2] against the nitrogen-enriched liquid [34] which is removed from an intermediate location in the high pressure column and subsequently warmed in a second subcooling heat exchanger [HX3] against the crude liquid oxygen stream [30] from the bottom of the high pressure column.

As shown in FIG. 4, the compression of the nitrogen rich overhead from the lower pressure column is performed after this stream is warmed in the main heat exchanger (ie warm compression). It should be noted that compression of the nitrogen rich overhead from the lower pressure column(s) in the present invention can also be performed before this stream is warmed in the main heat exchanger (ie cold compression). It should further be noted that it is possible to withdraw multiple nitrogen product streams of different purities from different locations in the high pressure column.

The skilled practitioner will appreciate that there are many other embodiments of the present invention which are within the scope of the following claims.

We claim:

1. A process for the cryogenic distillation of an air feed to produce a high pressure nitrogen product using a distillation column system comprising a high pressure column and one or more lower pressure columns comprising:

(a) feeding at least a portion of the air feed to the bottom of the high pressure column;

(b) removing a nitrogen-enriched overhead from the top of the high pressure column, collecting a first portion as the high pressure nitrogen product, condensing a second portion in a first reboiler/condenser and feeding at least a first part of the condensed second portion as reflux to an upper location in the high pressure column;

(c) removing a crude liquid oxygen stream from the bottom of the high pressure column, reducing the pressure of at least a first portion of it and feeding said first portion to the distillation column system for further processing;

(d) removing a nitrogen rich overhead from the top of each lower pressure column, compressing to the same pressure as the high pressure column and subsequently feeding in the gaseous state at least a first portion of one or more of said overheads to the high pressure column at a location which is below the removal location of the high pressure nitrogen product in step (b); and (e) removing an oxygen rich waste stream from the distillation column system.

2. The process of claim 1 wherein:

(i) the distillation column system comprises a single lower pressure column;

(ii) the first reboiler/condenser is located in the bottom of the single lower pressure column;

(iii) in step (c), the crude liquid oxygen stream is more specifically fed to an intermediate location in the single lower pressure column;

(iv) in step (d), the entire nitrogen rich overhead which is removed from the single lower pressure column is compressed and subsequently fed to the high pressure column;

(v) in step (e), the oxygen rich waste stream is more specifically removed from a lower location in the single lower pressure column; and (vi) a portion of the nitrogen-enriched liquid descending the high pressure column is removed from an intermediate location in the high pressure column, reduced in pressure and fed as reflux to the top of the single lower pressure column.

3. The process of claim 1 wherein:

(i) the distillation column system comprises two lower pressure columns, namely a first lower pressure column and a second lower pressure column;

(ii) the first reboiler/condenser is located in the bottom of the first lower pressure column;

(iii) in step (c), the crude liquid oxygen stream is more specifically fed to the top of the first lower pressure column;

(iv) in step (d), the entire nitrogen rich overhead which is removed from the first lower pressure column is fed to an intermediate location in the second lower pressure column while only a first portion of the nitrogen rich overhead from the second lower pressure column is compressed and subsequently fed to the high pressure column;

(v) a second portion of the nitrogen rich overhead from the second lower pressure column is condensed in a second reboiler/condenser located at the top of the second lower pressure column, a first part of the condensed second portion is fed as reflux to the top of the second lower pressure column and a second part of the condensed second portion is collected as a product stream;

(vi) a first oxygen-enriched vapor stream is removed from a location in the first lower pressure column immediately above the first reboiler/condenser, a second oxygen-enriched liquid stream is removed from the bottom of the first lower pressure column and both the first and second oxygen-enriched streams are fed to the bottom of the second lower pressure column; and (vii) an oxygen rich liquid stream is removed from the bottom of the second lower pressure column, reduced in pressure, vaporized in the second reboiler/condenser and removed as the oxygen rich waste stream.

4. The process of claim 1 wherein:

(i) the distillation column system comprises two lower pressure columns, namely a first lower pressure column and a second lower pressure column;

(ii) the first reboiler/condenser is located on top of the high pressure column;

(iii) in step (c), the crude liquid oxygen stream is more specifically fed to the first reboiler/condenser where it is vaporized and subsequently fed to the bottom of the first lower pressure column;

(iv) in step (d), only a first portion of the nitrogen rich overhead from the first lower pressure column is compressed and subsequently fed to the high pressure column and, similarly, only a first portion of the nitrogen rich overhead from the second lower pressure column is compressed and subsequently fed to the high pressure column;

(v) a second portion of the nitrogen rich overhead from the first lower pressure column is condensed in a second reboiler/condenser located at the top of the first lower pressure column and subsequently fed as reflux to the top of the first lower pressure column;

(vi) an oxygen rich liquid stream is removed from the bottom of the first lower pressure column, reduced in pressure, vaporized in the second reboiler/condenser and subsequently fed to the bottom of the second lower pressure column;

(vii) a second portion of the nitrogen rich overhead from the second lower pressure column is condensed in a third reboiler/condenser located at the top of the second lower pressure column and subsequently fed as reflux to the top of the second lower pressure column; and (viii) an oxygen rich liquid stream is removed from the bottom of the second lower pressure column, reduced in pressure, vaporized in the third reboiler/condenser and removed as the oxygen rich waste stream.

5. The process of claim 2 wherein:

(i) prior to feeding the air feed to the bottom of the high pressure column in step (a), the air feed is compressed, cleaned of undesirable impurities and cooled in a main heat exchanger to a temperature near its dew point;

(ii) prior to compressing the nitrogen rich overhead in step (d), said overhead is warmed in the main heat exchanger;

(iii) subsequent to compressing the nitrogen rich overhead in step (d), a portion of said overhead is removed as a product stream and the remaining portion is subsequently cooled in the main heat exchanger and fed to the high pressure column;

(iv) subsequent to removing the high pressure nitrogen product from the high pressure column in step (b), said product is warmed in the main heat exchanger;

(v) subsequent to removing the oxygen rich waste stream from the single lower pressure column in step (e), said waste stream is partially warmed in the main heat exchanger, expanded and re-warmed in the main heat exchanger; and (vi) prior to warming the nitrogen rich overhead in the main heat exchanger, said overhead is first warmed in a first subcooling heat exchanger against the nitrogen-enriched liquid which is removed from an intermediate location in the high pressure column and subsequently warmed in a second subcooling heat exchanger against the crude liquid oxygen stream from the bottom of the high pressure column.

* * * * *